US006357479B1

(12) United States Patent
Wagner et al.

(10) Patent No.: US 6,357,479 B1
(45) Date of Patent: Mar. 19, 2002

(54) ROTARY DISC VALVE

(75) Inventors: Peter Wagner, Gunzgen; Christoph Sägesser, Mägenwil, both of (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/451,137

(22) Filed: Nov. 30, 1999

(30) Foreign Application Priority Data

Dec. 9, 1998 (EP) ..... 98811214

(51) Int. Cl.[7] ..... B65H 5/30
(52) U.S. Cl. ..... 137/625.21; 251/96
(58) Field of Search ..... 137/625.21; 271/94, 271/96

(56) References Cited

U.S. PATENT DOCUMENTS

| | | | | |
|---|---|---|---|---|
| 3,069,025 A | | 12/1962 | Winkler et al. | |
| 3,572,686 A | * | 3/1971 | Day | 271/94 X |
| 3,913,478 A | * | 10/1975 | Terzuolo et al. | 271/94 X |
| RE29,289 E | * | 7/1977 | Terzuolo et al. | 271/94 X |
| 4,436,300 A | * | 3/1984 | Goi | 271/94 X |
| 4,540,024 A | * | 9/1985 | Bacardit | 137/625.21 |
| 4,739,982 A | * | 4/1988 | Hain | 271/94 |
| 4,997,006 A | * | 3/1991 | Zlobinsky et al. | 137/625.21 |
| 5,014,748 A | * | 5/1991 | Nogami et al. | 137/625.21 X |
| 5,125,637 A | * | 6/1992 | Glaser | 271/96 X |
| 5,480,137 A | * | 1/1996 | Haupenthal | 271/96 X |
| 5,685,534 A | * | 11/1997 | Zeltner | 271/96 X |
| 5,810,049 A | * | 9/1998 | Raque et al. | 137/625.11 |

FOREIGN PATENT DOCUMENTS

| | | |
|---|---|---|
| DE | 1024529 | 9/1954 |
| DE | 4315549 | 11/1994 |
| GB | 1227526 | 4/1971 |

OTHER PUBLICATIONS

Patent Abstracts of Japan, vol. 17, No. 430 (M–1460) Aug. 10, 1993 & JP 05 092679 A (Dainippon Printing Co LTD), Apr. 16, 1993.

* cited by examiner

*Primary Examiner*—Michael Powell Buiz
*Assistant Examiner*—Meredith H. Schoenfeld
(74) *Attorney, Agent, or Firm*—Friedrich Kueffner

(57) ABSTRACT

A rotary disc valve with a stationary valve plate provided with a vacuum connection, a rotary slide member mounted so as to be movable between first and second valve positions, wherein the slide member has a breakthrough connecting the vacuum connection to a suction opening in the first valve position, wherein the suction opening is connected to an aerating opening in the second valve position, and wherein both valve positions define a suctioning angle. The valve further includes a device for adjusting the size of the suctioning angle.

13 Claims, 7 Drawing Sheets

ROTARY DISC VALVE

BACKGROUND OF THE INVENTION

1. Field of the Invention

The present invention relates to a rotary disc valve with a stationary valve plate provided with a vacuum connection, a rotary slide member mounted so as to be movable between first and second valve positions, wherein the slide member has a breakthrough connecting the vacuum connection to a suction opening in the first valve position, wherein the suction opening is connected to an aerating opening in the second valve position, and wherein both valve positions determine a suctioning angle.

2. Description of the Related Art

Rotary disc valves of the above-described type are used particularly for controlling the vacuum of suction devices which are arranged at opening drums of a feeder. Such opening drums can be used for opening envelopes and folded sheets which are closed at the heads thereof without overlay folds and for placing the envelopes or folded sheets onto a collector chain. The rotary disc valve is arranged at one end of the shaft of the opening drums provided with the suction devices and is connected through a flexible line to a vacuum pump or another suitable vacuum source. The suction devices are connected to the vacuum source during each rotation of the opening drums. The flaps of the sheets to be opened are suctioned and, when the opening drums rotate further, the envelopes or folded sheets are opened in the middle thereof. Subsequently, the suction devices are once again aerated and the spread-apart envelopes or folded sheets are placed onto the collector chain. It is essential that the suctioning and aerating moments are adapted precisely to the envelopes or folded sheets and particularly to the sizes thereof.

In a rotary disc valve which is known in the art, the suction devices can be adjusted at the circumference of the opening drum in order to adapt to different products. In addition, it is possible to adjust the valve plate on which the flexible valve line is arranged. When the valve plate is adjusted, the moment of suctioning as well as the moment of aerating are simultaneously shifted. Consequently, when adjusting the opening drum, it was necessary in the past to adjust the suction devices at the circumference of the opening drum, on the one hand, and to adjust the control disc, on the other hand. Therefore, the optimum adjustment was relatively cumbersome in the past and had to be carried out while the drum is standing still.

JP 050 92 679 A discloses a rotary disc valve of the above-described type in which a valve plate 22 is provided which is rotatable in order to adjust the suctioning moment. For this purpose, a clamping ring 24 is provided which can be releasably connected to the valve plate by means of a locking screw 25. This clamping ring must be released for adjusting the valve plate. The rotary disc valve is mounted at the end of a hollow shaft of the opening drum. For adjusting the opening moment, it is required that the opening drum stands still. Consequently, an adjustment during operation is not possible.

SUMMARY OF THE INVENTION

Therefore, it is the primary object of the present invention to provide a rotary disc valve of the above-described type which is particularly suitable for an opening drum of a feeder and which makes possible a simpler adjustment of the moments when suctioning begins and ends.

In accordance with the present invention, the above-described object is met by providing means for adjusting the size of the suctioning angle.

Contrary to the present invention, in rotary disc valves of the prior art the suctioning angle was always fixed and could not be adjusted. Consequently, when the moment of aerating was adjusted, the suctioning moment was always adjusted simultaneously and inevitably by the same angle. In the rotary disc valve according to the present invention, on the other hand, the aerating moment can be adjusted while the moment of suctioning remains fixed and, thus, the size of the suctioning angle can be adjusted within a predetermined range. By adjusting the aerating moment, the suctioning angle becomes smaller or greater.

In accordance with a preferred feature, the rotary disc valve includes a slide member which is adjustable and particularly rotatable during operation for changing the size of the suctioning angle.

The rotary disc valve according to the present invention can be realized with a relatively small number of robust components.

In accordance with a preferred embodiment, the rotary disc valve is composed of a valve plate on which the flexible vacuum line is mounted, a slide member and a control disc as the means for adjusting the size of the suctioning angle. The slide member is fixedly secured to a shaft and rotates together with the shaft. The stationary control disc is mounted at the outer end of the shaft and includes an axial passage connected through a breakthrough of the slide member to a suction duct. This suction duct preferably extends through the shaft of the opening drums.

In accordance with another embodiment of the invention, the valve plate has a recess extending in the circumferential direction, wherein a slide member is mounted in the recess so as to divide the recess into two chambers. One of the chambers is connected through a passage to the vacuum source and the other chamber is connected through a passage to the aerating opening. This embodiment also requires essentially only three simple and robust components.

The rotary disc valve is preferably used in a suction drum, particularly the opening drum of a feeder, especially for a saddle stitcher.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
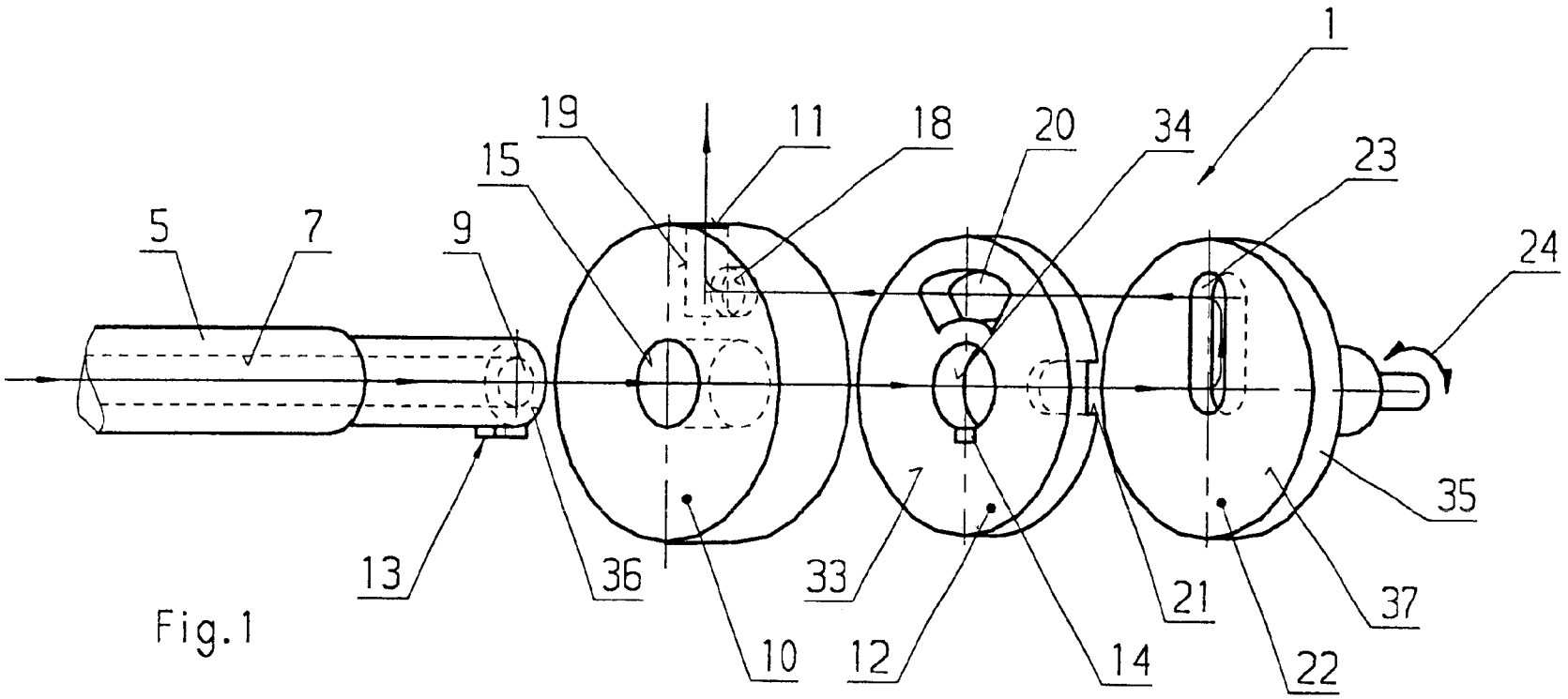
FIG. 1 is a schematic exploded perspective view of a rotary disc valve according to the present invention and of a portion of a hollow shaft.
Figure 2:
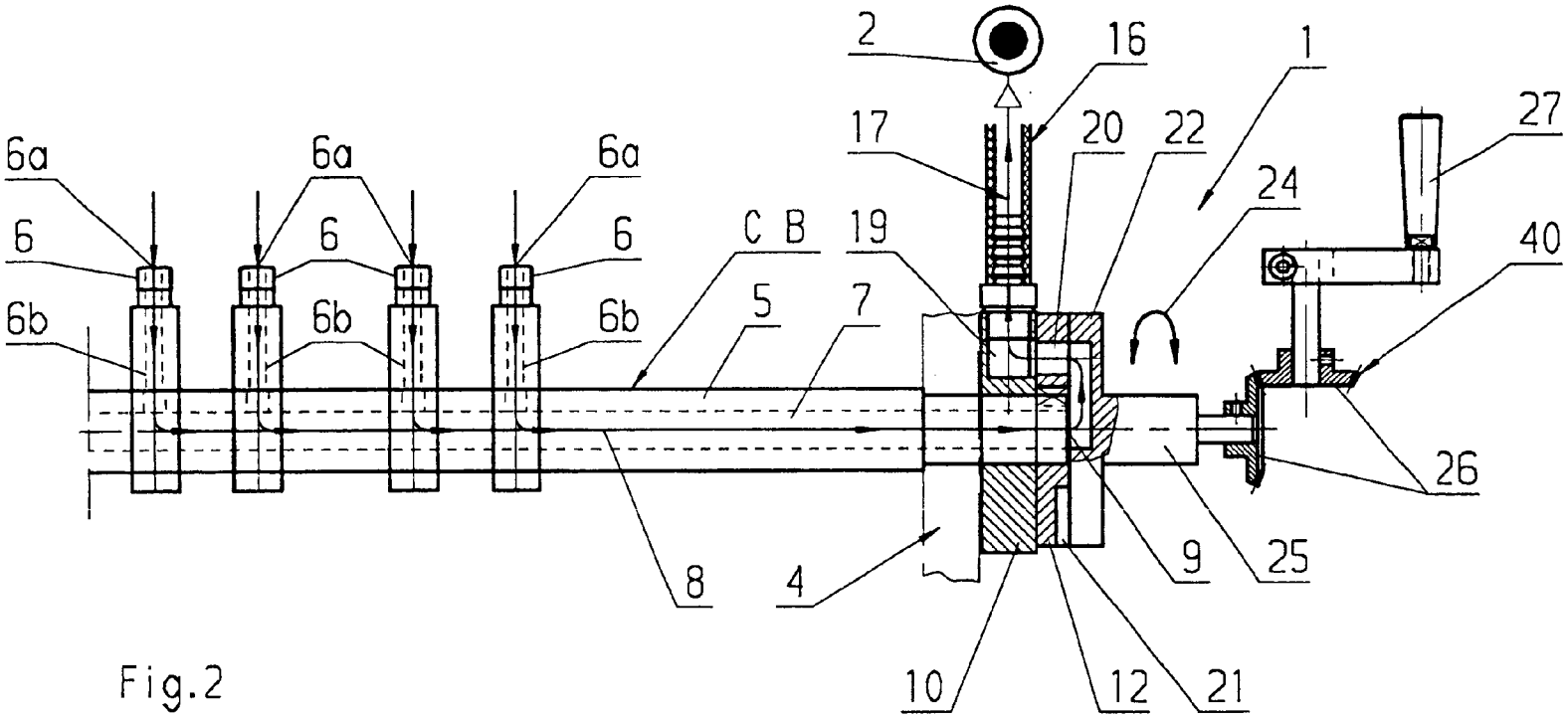
FIG. 2 is a schematic sectional view of the rotary disc valve of FIG. 1.

As illustrated in FIGS. 1 and 2 of the drawing, the first embodiment of the rotary disc valve 1 according to the present invention includes a valve plate 10, a slide member 12 and a control disc 22. The valve plate 10, which is preferably made of synthetic material, includes a duct 19 with an opening 11 to which a flexible vacuum line 16 is connected which, in turn, leads to a vacuum pump 2 or another vacuum source. A central continuous bore 15 receives a hollow shaft 5 of an opening drum B or C. The valve plate 10 is connected to a machine housing 4 and, thus, is stationary relative to the shaft 5. The duct 19 extends radially and has, in addition to the opening 11 arranged at the circumference, another opening 18 which is directed in the axial direction towards the slide member 12. The valve plate 10 is preferably mounted on the housing 4 in such a way that it can be released and turned, so that the opening 18 can be adjusted in the circumferential direction.

The slide member 12 has a central bore 34 with a groove 13 for receiving the shaft 5 and a key 13. The key 13 engages in the groove 14 and connects the slide member 12 to the shaft 5 such that the slide member 12 and the shaft 5 rotate together. A kidney-shaped breakthrough 20 is worked into the slide member 12 at a distance from the bore 14. Also worked into the slide member 12 is a recess 21 at the circumference which forms an aerating opening.

The control disc 22 has a disc-shaped portion 35 and, as shown in FIG. 2, an axially protruding cylindrical portion 25. A radially extending passage 23 is worked into the disc-shaped portion 35; as shown in FIG. 2, the passage 23 is permanently connected to a duct 7 of the shaft 5. For this purpose, the duct 7 has at an end thereof an opening 9 which is connected in an air-tight manner to the passage 23. The control disc 22 is secured to a housing and can be turned at the cylindrical portion 25 in both directions of the arrow 24. For sealing the shaft 5 relative to the control disc 22, the shaft 5 has a planar end face 36 which slidingly and tightly rests against a planar inner side 37 of the control disc 22. For rotating the control disc 22 in the two directions of the double arrow 24, the portion 25 is connected, for example, to two bevel gears 26. By turning the lever 27, the control disc 22 can be shifted manually in one of the two directions of the arrow 24. The bevel gears 36 and the lever 27 only serve as an example of a suitable adjusting means 40.

Figure 3:
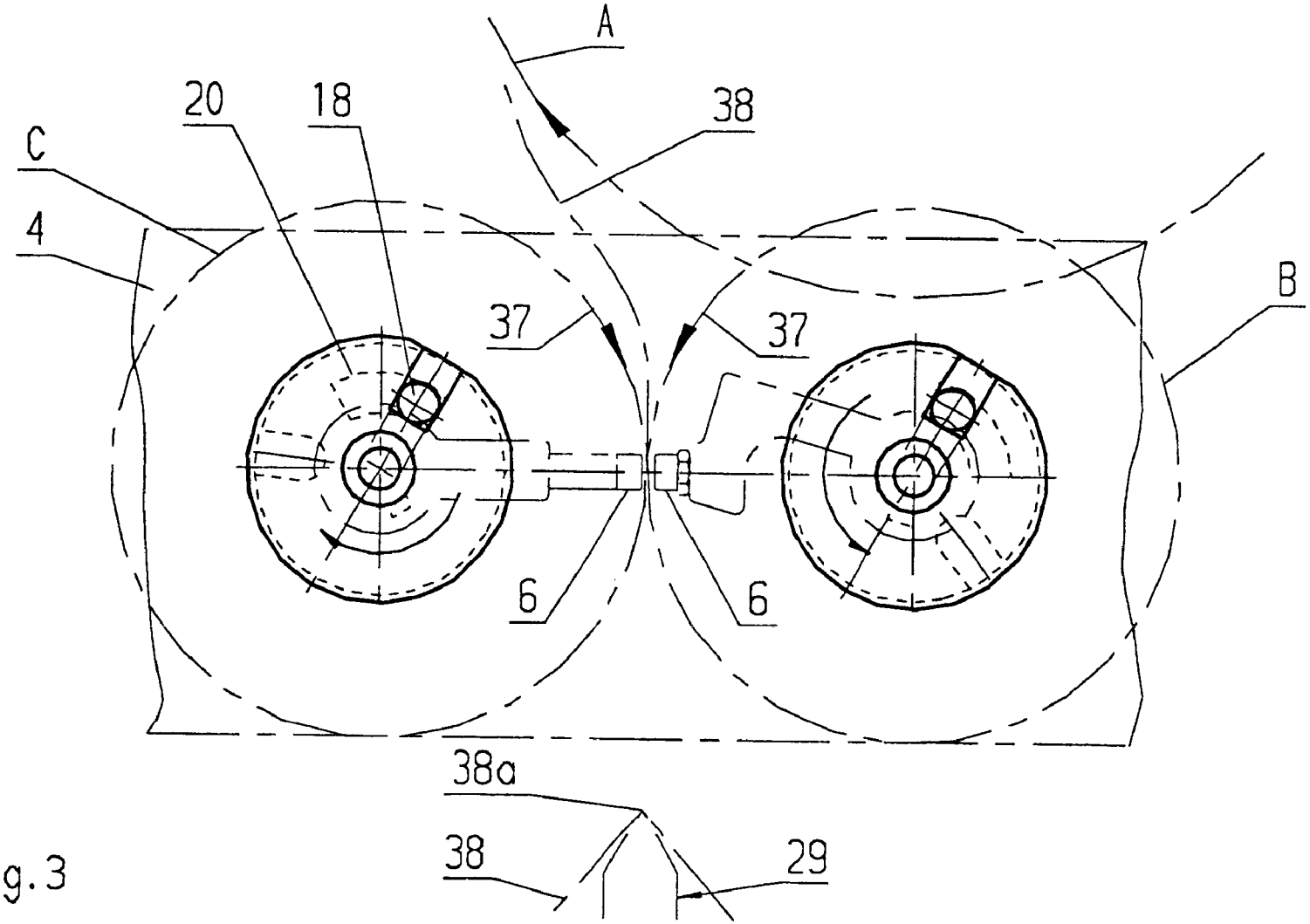
FIG. 3 is a schematic front view of two opening drums each provided with a rotary disc valve according to the present invention as shown in FIGS. 1 and 2, wherein the suction devices are shown in the active state.

FIG. 3 shows two suction drums B and C which are each provided with a suction device 6 and have the purpose of placing envelopes or folded sheets 38 with a head flap **38*a* onto a schematically indicated collector chain 29. Arranged above the two suction drums C and B is another drum A which is known in the art and has the purpose of pulling the envelopes or folded sheets from a stack, not shown, and to supply them to the two suction drums B and C. The envelopes or folded sheets 38 to be opened travel from above between the two suction drums B and C which rotate towards each other as indicated by the arrows 37. If, as indicated in FIG. 3, a folded sheet 38 is located between the two suction drums B and C, the two flaps of this folded sheet 38 are suctioned by the suction devices 6. As illustrated in FIG. 2, the suction devices 6 are mounted respectively on the shafts B and C and each has a suction opening 6*a* which is connected through a bore 6*b* to the duct 7 of the shaft 5. The suction devices 6 rotate together with the shaft 5 and, depending on the position of the rotary slide valve 1, are connected to the vacuum source 2 or through the aerating openings 21** to ambient air.

Figure 7:
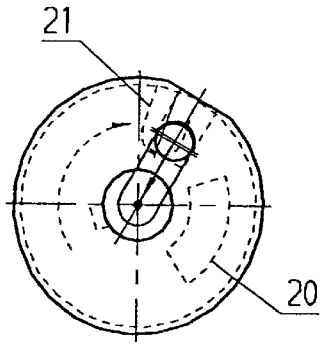
FIG. 7 is a schematic additional view of the rotary disc valve of FIG. 1.

FIGS. 1 and 2 of the drawing show a position of the rotary disc valve 1 in which the suction devices 6 are connected to the vacuum source 2 and, thus, the suction devices 6 are in the active state. The kidney-shaped breakthrough 20 of the slide member 22 is located in a position in which the breakthrough 20 connects the duct 19 of the valve plate 10 to the passage 23 of the control disc 22. FIG. 2 shows a line 8 which indicates the connection of the vacuum openings 6 to the vacuum source 2. As shown in FIG. 3, the breakthrough 20 of the suction drum C rotates in the clockwise direction. The opening 18 is located at the beginning of the kidney-shaped breakthrough. This position of the breakthrough 20 relative to the opening 18 determines the beginning moment of the suctioning angle. When the slide member 12 with the breakthrough 20 rotates further in the clockwise direction, the suction devices 6 continue to be connected to the vacuum source 2 and, thus, remain active. Finally, when the opening drum C rotates further in the clockwise direction, the breakthrough 20 of the slide member 12 reaches the position shown in FIG. 7 in which the recess 21 is connected to the passage 23 of the control disc 22. In this position of the slide member 12 shown in FIG. 8, the duct 7 is connected to ambient air.

Figure 8:
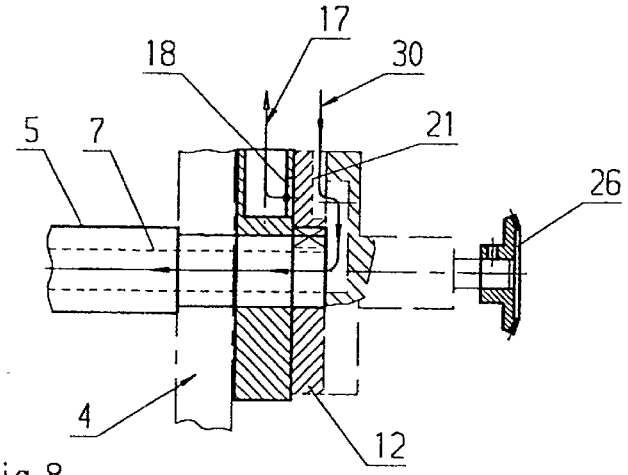
FIG. 8 is a schematic additional view of the rotary disc valve shown partially in section.

FIG. 8 shows a line 30 which indicates the path along which ambient air flows to the suction devices 6. Consequently, the suction devices 6 are aerated and the folded sheet 30 is released by the opening drums B and C and is dropped onto the collector chain 29.

Figure 6:
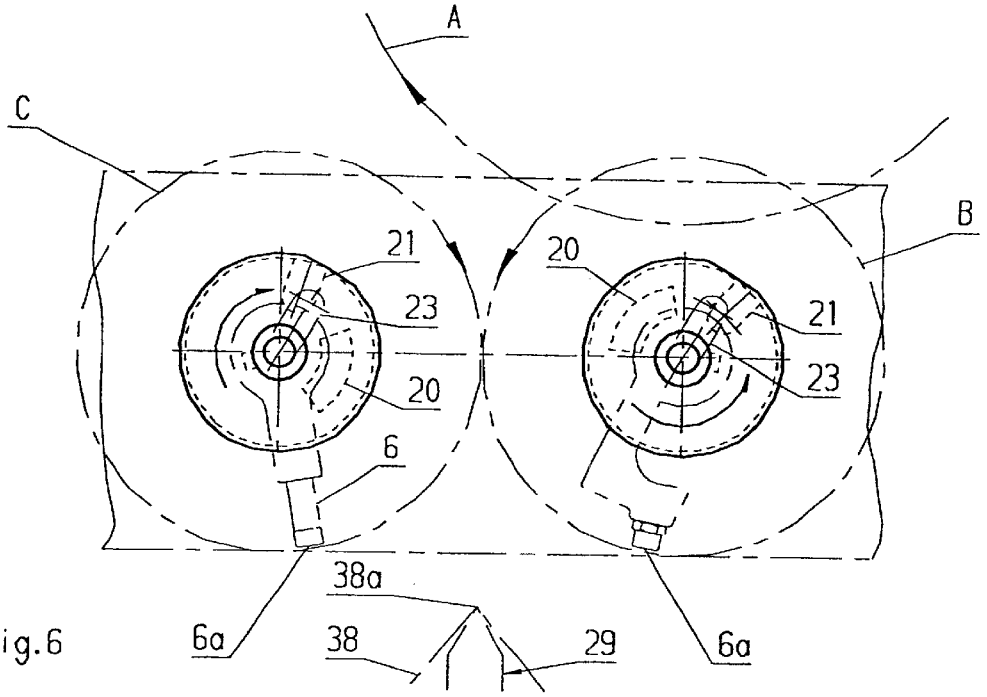
FIG. 6 is a view similar to FIG. 3, wherein the suction devices are shown in the non-active state.

FIG. 6 of the drawing shows this position of the suction devices 6 which, as mentioned, are aerated and, thus, inactive. An essential aspect is the fact that this aerating position is determined by the position of rotation of the control disc 22 and particularly of the passage 23. If this aerating position and, thus, the point in time at which the folded sheets 38 are to be released, are to be adjusted, the passage 23 is adjusted by rotating the control disc 22 in the directions of the arrow 24.

Figure 4:
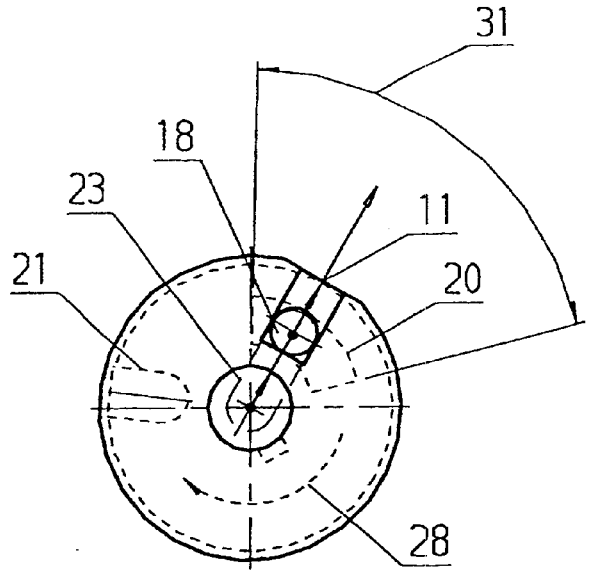
FIG. 4 is a schematic front view of the rotary slide valve.
Figure 5:
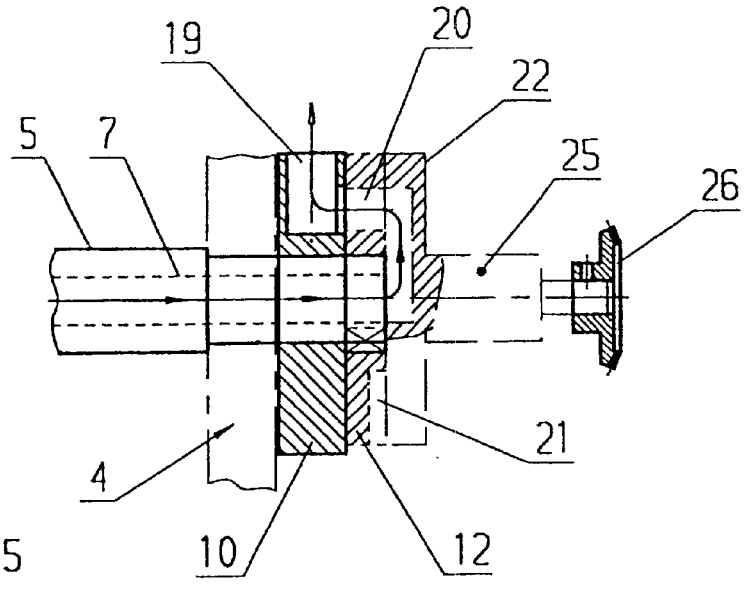
FIG. 5 is a side view, partially in section, of a rotary slide valve.

The adjustment range is shown in FIG. 4 and indicated by reference numeral 31. If the passage 23 shown in FIG. 4 is adjusted in the counterclockwise direction, the suction devices 6 are aerated earlier and, thus, the suctioning angle is reduced. In contrast, when the passage 23 is shifted in the clockwise direction, aerating takes place later.

FIG. 6 of the drawing clearly shows how the passage 23 overlaps the aerating recess 21. As a result, the suction openings 6*a* are connected through the passage 23 and the aerating recess 21 to the ambient atmosphere. The kidney-shaped breakthrough is located outside of the opening 18 and is therefore not connected to the vacuum source 2.

An essential advantage of the rotary disc 1 is seen in the fact that the vacuum source 2 does not continue to suction, but is closed because the slide member 12 covers the opening 18, as shown in FIG. 8. Consequently, aerating of the suction devices 6 takes place at a freely selectable moment which is dependent on the position of the control disc 22 relative to the slide member 12. Since, as mentioned, the control disc 22 is adjustable during operation, the release behavior or the release moment of the sheets 32 onto the collector chain 29 can be optimized and, thus, the running speed can be increased. This is basically also possible in the rotary disc valve 51 shown in FIGS. 9 to 12 which will be explained in the following.

Figure 9:
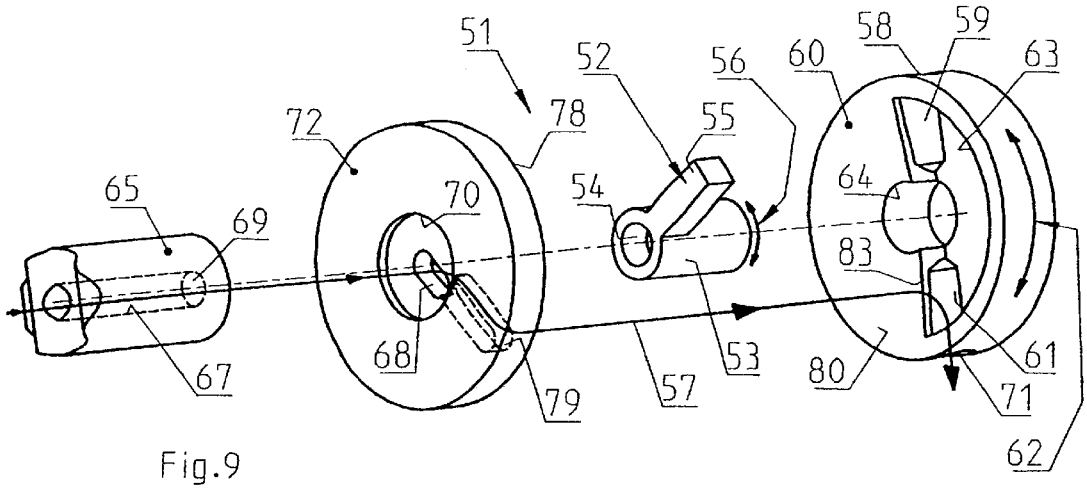
FIG. 9 is a schematic view of another embodiment of the rotary disc valve, wherein the components are also shown moved apart in axial direction.
Figure 10:
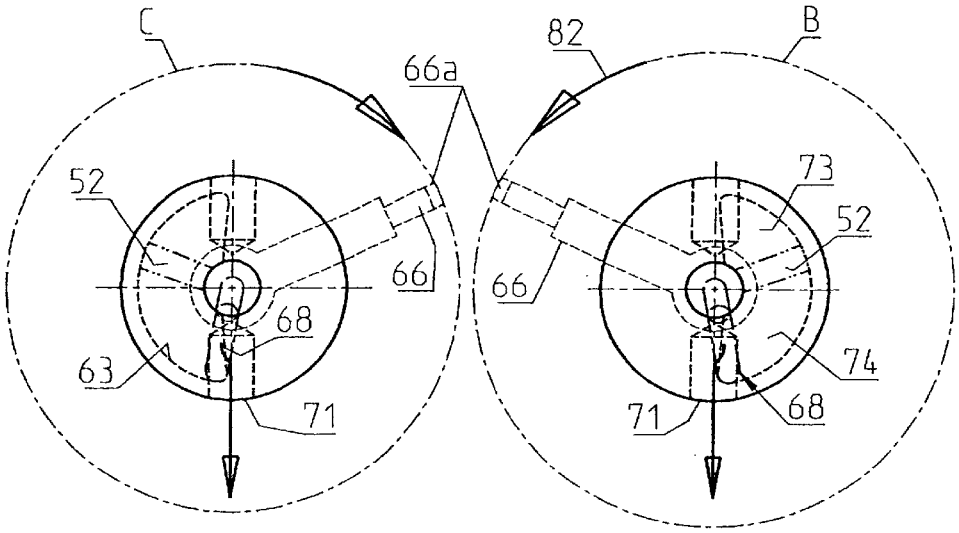
FIG. 10 is a front view of two opening drums each provided with a rotary disc valve of FIG. 9.
Figure 12:
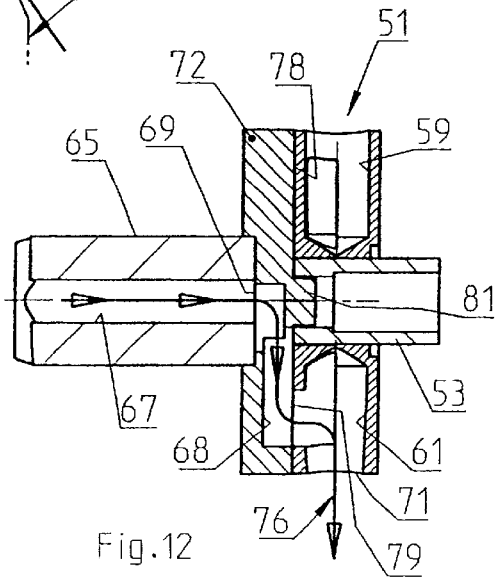
FIG. 12 is a schematic sectional view of the rotary disc valve of FIG. 9.

The rotary disc valve 51 is also mounted on a hollow shaft 65 which is provided with a duct 67 with an opening 69. A slide member 72 has a central blind-end bore 70 engaged by the hollow shaft 65. Using means which are not shown, for example, a screw connection, the shaft 65 is secured to the slide member 72. The duct 67 is connected permanently and in an air-tight manner to a radially extending breakthrough 68 which, as illustrated in FIG. 12, ends on a planar rear side 78 in a radially extending opening 79. The slide member 72 slides with its planar surface 78 on a valve plate 60 which is preferably made of synthetic material and is fastened so as to be stationary on the machine frame, not shown. Worked into the surface 80 of the valve plate 60 which rests against the slide member 72 is a recess 63 which, as illustrated in FIG. 9, is approximately half moon-shaped and includes approximately half of a central throughbore 64. The valve plate 60 is preferably mounted on the machine frame in such a way that it can be released and turned.

Figure 11:
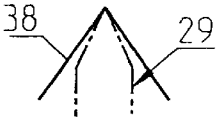
FIG. 11 is a schematic front view of the rotary disc valve of FIG. 9.
Figure 11:
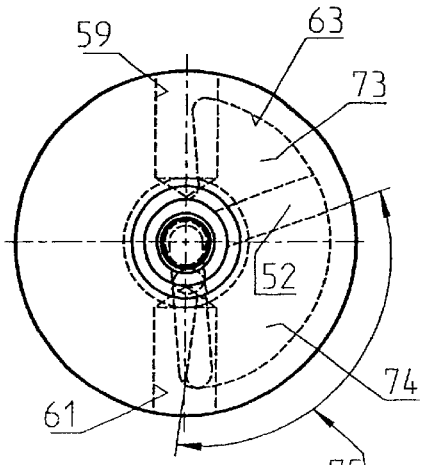

Placed in the recess 63 and the throughbore 64 is a slide piece 52 which includes a cylindrical portion 53 and which, as illustrated in FIG. 12, protrudes from the rear side of the valve plate 60. As shown in FIG. 12, a guide pin 81 of the slide member 72 projects into a bore 54 of the slide piece 52. As shown in FIG. 11, a radially protruding arm 55 divides the recess 63 into two chambers 73 and 74. By turning the slide piece 52 at the protruding part 53, the arm 55 can be adjusted in the circumferential direction and, thus, the two chambers 73 and 74 can be made smaller or larger. Rotating the slide piece 52 can be effected with the adjusting means 40 illustrated in FIG. 2.

The recess 63 is connected to two radially extending bores 59 and 61 which, as shown in FIG. 9, have an opening 58 or 71, respectively, which ends at the circumference. The opening 71 is connected through a flexible hose, not shown, to the vacuum source 2. Consequently, independently of the position of the slide piece 52, the chamber 73 is connected to the ambient atmosphere and the chamber 74 is connected to the vacuum source 2.

The manner of operation will now be explained in the following as shown in FIGS. 10 to 15 in connection with the opening drum B.

The opening drum B has at least one suction device 66 with a suction opening 66*a* and rotates in the direction of the arrow 82. The shaft 65 and the slide member 72 rotate in the same direction. In the position illustrated in FIG. 10, the breakthrough 68 and the opening 79 have reached the recess 63 and especially the chamber 74. Consequently, the breakthrough 68 connects the duct 67 of the hollow shaft 65 to the bore 61 and, thus, to the vacuum source 2, as clearly indicated by line 76 in FIG. 12. In this manner, the suction opening 66*a* is in connection with the vacuum source 2. This connection is maintained until the breakthrough 68 reaches via the opening 79 the chamber 73 and, thus, the breakthrough 68 is connected through the bore 59 and the opening 58 to the ambient atmosphere. Consequently, the suction device 66 is being aerated. It is also essential in this connection that during aerating the vacuum source 2 does not suction into the open because the chamber 74 is closed during aerating. The opening drum C rotates in the opposite direction, but otherwise operates in the same manner as the opening drum B. Both drums B and C have their own rotary disc valve 51 and, thus, can be adjusted independently of each other. It is essential also again in this case that, when the slide member 52 is adjusted, the moment of aerating is adjusted, but not the moment of suctioning. However, the suctioning moment can be adjusted by turning the valve plate 60. By turning the valve plate 60 in one of the directions of the double arrow 62, the suction edge 83 is correspondingly rotated in the clockwise direction. If, in accordance with FIG. 10, the valve plate 60 of the opening drum B is turned in the clockwise direction, the suction device 66 is activated earlier, while in the opposite direction the activation takes place later. The aerating moment would be adjusted simultaneously, however, this is prevented by holding the slide piece 52 in place. The adjustment of the slide piece 52 can be effected also by means of bevel gears 26 or another suitable adjusting means.

Figure 13:
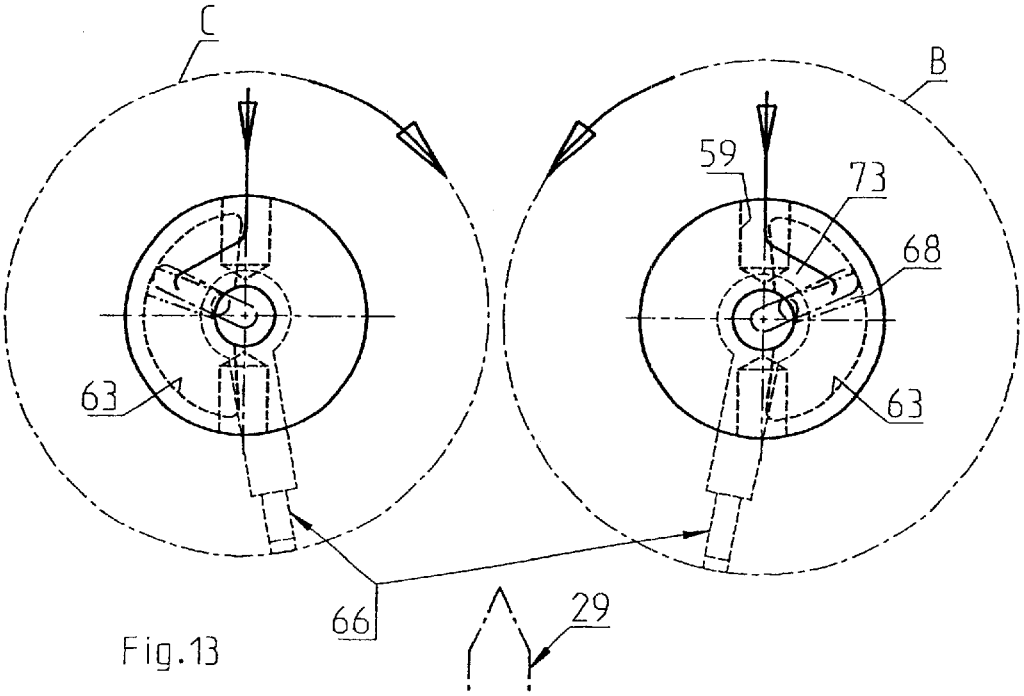
FIG. 13 is a schematic additional front view of the two opening drums, wherein the suction devices are shown in the non-active state.
Figure 14:
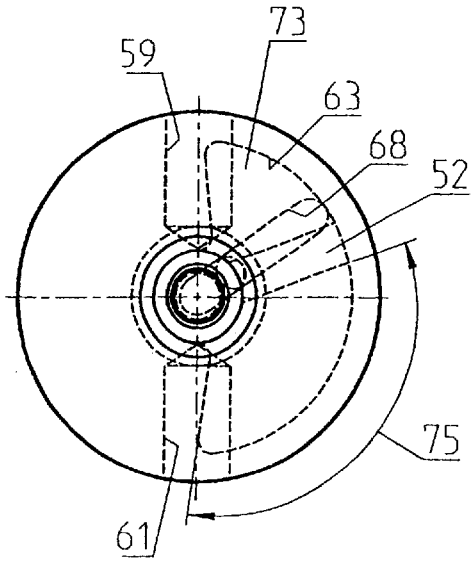
FIG. 14 is another schematic front view of the rotary disc valve of FIG. 9.
Figure 15:
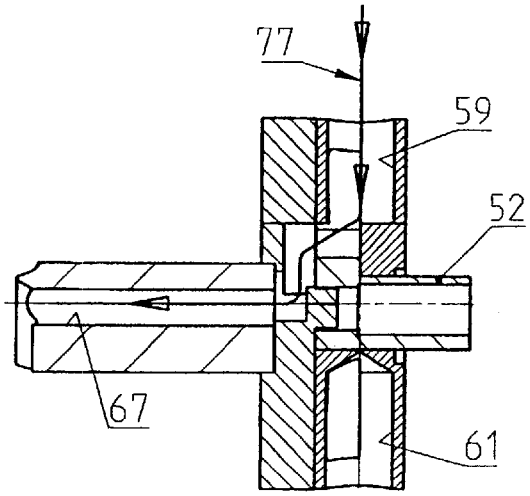
FIG. 15 is another schematic sectional view of the rotary disc valve of FIG. 9.

FIGS. 13 to 15 of the drawing show the rotary disc valve 51 in the aerating position. Consequently, the breakthrough 68 is connected to the chamber 73 which, in turn, has a connection to the bore 59. The adjusting range of the slide member 52 is indicated in FIG. 14 by the double arrow 75. If the angle indicated by double arrow 75 in FIG. 14 is reduced, the suction devices 66 are aerated earlier. The suctioning moment, on the other hand, is not changed. An arrow 77 shows in FIG. 15 the path along which the ambient air flows to the suction devices 66.

The invention is not limited by the embodiments described above which are presented as examples only but can be modified in various ways within the scope of protection defined by the appended patent claims.

We claim:

1. A rotary disc valve comprising a stationary valve plate having a vacuum connection, a rotary slide member mounted so as to be movable between first and second valve positions, wherein the slide member has a breakthrough connecting the vacuum connection to a suction opening in the first valve position, wherein the suction opening is connected to an aerating opening in the second valve position, and wherein both valve positions define a suctioning angle, further comprising means for adjusting a size of the suctioning angle, further comprising an opening drum mounted on a shaft, wherein the means for adjusting the suctioning angle is mounted on the opening drum, and wherein the opening drum includes at least one suction device for opening printed products.

2. The valve according to claim 1, wherein the means for adjusting the suctioning angle is configured to be adjustable during operation.

3. The valve according to claim 1, wherein the means for adjusting the suctioning angle comprises a control disc configured to be rotatable during operation, further comprising a slide member, wherein the control disc has a passage for connecting a breakthrough of the slide member to a duct.

4. The valve according to claim 3, wherein the control disc has a protruding portion, and wherein the control disc is mounted so as to be rotatable during operation on the protruding portion.

5. The valve according to claim 3, wherein the passage of the control disc is a radially extending slot.

6. The valve according to claim 3, wherein the slide member is mounted between the valve plate and the control disc so as to be slidingly sealed relative to the valve plate and the control disc.

7. The valve according to claim 6, wherein the breakthrough of the slide member is kidney-shaped and extends in a circumferential direction.

8. The valve according to claim 6, wherein the slide member has a recess for aerating the at least one suction device, and wherein the recess is connected to the passage of the control disc in a predetermined position of rotation of the slide member.

9. The valve according to claim 1, wherein the valve plate has a recess, and wherein an adjustable slide piece is mounted in the recess.

10. The valve according to claim 9, wherein the recess has two chambers separated by the slide piece, wherein a first of the chambers is connected to a suction opening and a second of the chambers is connected to an aerating opening.

11. The valve according to claim 9, wherein the adjustable slide piece has a radially extending arm and a coaxially extending part configured to be rotatable during operation.

12. The valve according to claim 9, wherein the slide member has a radially extending breakthrough connectable in a center of the slide member to a duct of a shaft and connectable to a recess of the valve plate.

13. The valve according to claim 1, wherein the valve is mounted on an opening drum of a feeder.

* * * * *